United States Patent [19]

Kitchen

[11] Patent Number: 4,706,390

[45] Date of Patent: Nov. 17, 1987

[54] DEHYDRATOR

[75] Inventor: John A. Kitchen, R.R. #3, Hastings, Ontario, Canada, K0L 1Y0

[73] Assignee: John A. Kitchen Ltd., Hastings, Canada

[21] Appl. No.: 851,171

[22] Filed: Apr. 14, 1986

[51] Int. Cl.[4] ..... F26B 17/00

[52] U.S. Cl. ..... 34/57 R; 431/1; 34/79

[58] Field of Search ..... 431/1; 34/57 R, 79 R; 432/67, 71

[56] References Cited

FOREIGN PATENT DOCUMENTS 2810045 9/1979 Fed. Rep. of Germany ..... 34/57 R

*Primary Examiner*—Carroll B. Dority, Jr.

*Attorney, Agent, or Firm*—Rogers, Bereskin & Parr

[57] ABSTRACT

A dehydrator for fluent materials includes a pulse combustor and a cyclone separator having a cylindrical cyclone chamber and a central gas discharge tube. The pulse combustor has a finned tail pipe which is contained within a casing disposed generally tangentially to a cylindrical wall of the cyclone chamber. Material to be dried is introduced into the tail pipe and is discharged in a spiral pattern that flows downwardly around the gas discharge tube. Material in the gas stream falls into a collection hopper below the cyclone chamber. Gases leave through the gas discharge tube. In an alternative embodiment, a simpler dried material collection chamber is used.

17 Claims, 4 Drawing Figures

DEHYDRATOR

FIELD OF THE INVENTION

This invention relates generally to dehydrators for fluent materials.

BACKGROUND OF THE INVENTION

Many materials ranging from food-stuffs to sewage sludge and including both liquids and particulate materials must have water removed, for example to produce marketable products or to facilitate transportation and/or disposal of the material. Processes for dehydration involve moving the material through a zone of heated air which is usually blown at high velocity. The dried material is then separated from the air and collected. Heat for evaporation of water during these processes is usually provided by gas or oil, depending on the nature of the materials and the requirements of the end product.

It has been known for many years that the rate of drying can be greatly increased by imposing sound waves on the material in the presence of heated air. For example, this phenomenon is discussed in "Sonic Drying" by Robert S. Soloff (the Journal of the Acoustical Society of America - Volume 36 Number 5, May 1964). However, the additional cost of the energy required for the sound generator has generally not been thought justified commercially.

Pulsating combustion has been recognized as an obvious method of providing the heat, high velocity and intense sonic waves required for dehydration. This principle was first used to propel the flying bomb of World War II and was later used in highly efficient heating apparatus such as the Hydropulse Boiler and the Lennox Pulse Furnace.

DESCRIPTION OF THE PRIOR ART

U.S. Pat. Nos. 2,916,032 and 4,309,977 (both granted to John A. Kitchen) illustrate the hydropulse boiler. An early example of a pulse combustor employing a one-way air inlet valve similar to that used in the Lennox Pulse Furnace is shown in U.S. Pat. No. 2,808,978 (John A. Kitchen et al.). Generally, these known pulse combustors used for heating have employed one or more pressure responsive valves to control entry of fuel charges to the combustor.

Valveless pulse combustors are also known and have been used in commercial dehydrators. One example of such a dehydrator is known as "Sonodyne" and is shown in U.S. Pat. No. 3,462,955 (Lockwood). This dehydrator employs a pulsating combustor which is shaped in the form of a "U". While the dehydrator is believed to have met with some success, the U-shaped combustor configuration is costly to construct and is less efficient than an "in-line" combustor. Tests have been conducted with in-line valveless combustors for dehydration and again, while some success has been encountered, this type of combustor provides very little energy for propelling the material and gases through the system. Fundametally, this combustor is a sound generator and a large auxially blower is required for proper operation.

It has also been proposed by Lockwood (U.S. Pat. No. 3,618,655) to use pulse combustors in combination with a "cyclone" type of separator. However, it is believed that the separator configuration shown in this patent would be relatively inefficient if only one combustor was employed, as circulation within the chamber would be unsatisfactory.

An object of the present invention is to provide for efficient dehydration of materials using a pulse combustor and in which the dried material can be efficiently removed from the exhaust gases of the combustor.

SUMMARY OF THE INVENTION

In one aspect, the invention provides a dehydrator comprising a pulse combustor and a collection chamber in the form of a cyclone separator. The combustor has an elongate tail pipe with an inlet for fluent material to be dehydrated and an outlet through which the material is discharged in a pulsating exhaust gas stream when the combustor is in operation. The cyclone separator includes a cyclone chamber having a cylindrical wall extending about a generally vertical axis, a closed upper end wall, and an inlet defined by the tail pipe of the pulse combustor. Dried material collection means is provided at a lower end of the cyclone chamber. A gas discharge tube is disposed generally centrally of the chamber and extends to a gas outlet from the separator, and means is provided for discharging gases from the separator through the tube. The tail pipe of the combustor is oriented to direct the material and gas stream tangentially into the cyclone chamber so that said stream travels in a spiral flow pattern downwardly around the gas discharge tube. Dried material then tends to separate and fall under gravity into the dried material collection means, while gases leave the chamber through the gas discharge tube.

In operation, the combined effects of the high temperature exhaust gases and the sonic pulses of the pulse cycle of the combustor will efficiently dry the material introduced into the tailpipe of the combustor. The cyclone separator will then efficiently remove the dried material from the gas stream. Unlike conventional cyclone separators used for drying, the changes in pressure due to the sonic waves causes a squeezing action on the material which, with the scrubbing action of the high temperature gases, evaporates the water at a phenomenal rate.

In another aspect, the invention provides a dehydrator having a pulse combustor of the general form defined above, arranged to discharge into a collection chamber. The pulse combustor is provided with a plurality of external cooling fins extending generally longitudinally of the tail pipe, a shroud enclosing said fins and defining therewith dilution air passageways extending into the cyclone chamber and along which air is drawn by injection of high velocity gases leaving the tail pipe in use, and means for controlling the volume of combustion air flowing through said passageways.

BRIEF DESCRIPTION OF THE DRAWINGS

In order that the invention may be more clearly understood, reference will now be made to the accompanying drawings which illustrate two preferred embodiments of the invention by way of example, and in which.

DESCRIPTION OF THE PREFERRED EMBODIMENTS

Figure 1:
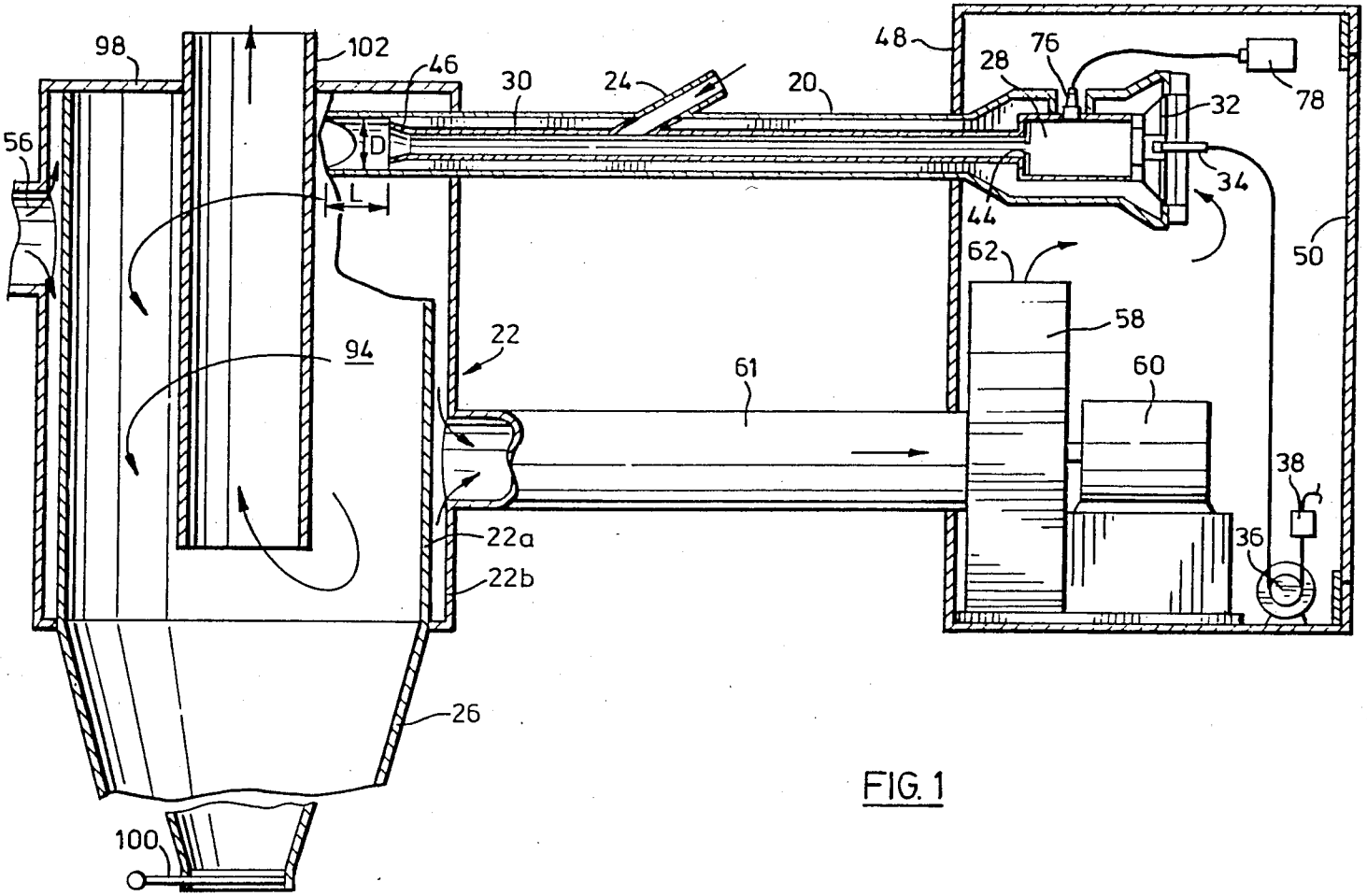
FIG. 1 is a somewhat diagrammatic side elevational view, partly in section, of a dehydrator in accordance with a first embodiment of the invention.

Referring first to FIG. 1, the dehydrator includes a pulse combustor generally denoted by reference numeral 20 and a cyclone separator 22. Combustor 20 provides the necessary amount of heat and high velocity gas for drying moist or wet material flowing through a material inlet 24 at a given rate of flow. The cyclone separator 22 then collects and separates air and combustion gases from the solid material and permits that material to be collected in a hopper 26.

Pulse combustor 20 has a so-called "in line" configuration and includes a combustion chamber 28 of cylindrical form and a tail pipe 30 disposed in line with the axis of the combustion chamber. The combustor itself is designed on principles which are essentially well-known. The combustion chamber 28 and tail pipe 30 form a reasonant system. Successive fuel charges introduced into the combustion chamber are ignited. At each cycle, combustion gases expand into the tail pipe 30 and form a high velocity gas stream that leaves the outer end of the tail pipe. This creates a partial vacuum within the combustion chamber 28 that draws the combustion gases back into the chamber along with some induced air, together with a fresh fuel charge which is then ignited to establish the next cycle.

Reference may be had to the patents of John A. Kitchen identified above and to a co-pending United States patent application Ser. No. 815,488 filed Jan. 2, 1986, now U.S. Pat. No. 4,640,674, and entitled "Pulse Combustion Apparatus" in the name of John A. Kitchen for a detailed description of the combustor itself. The subject matter of the co-pending application is incorporated herein by reference.

Figures 2, 4:
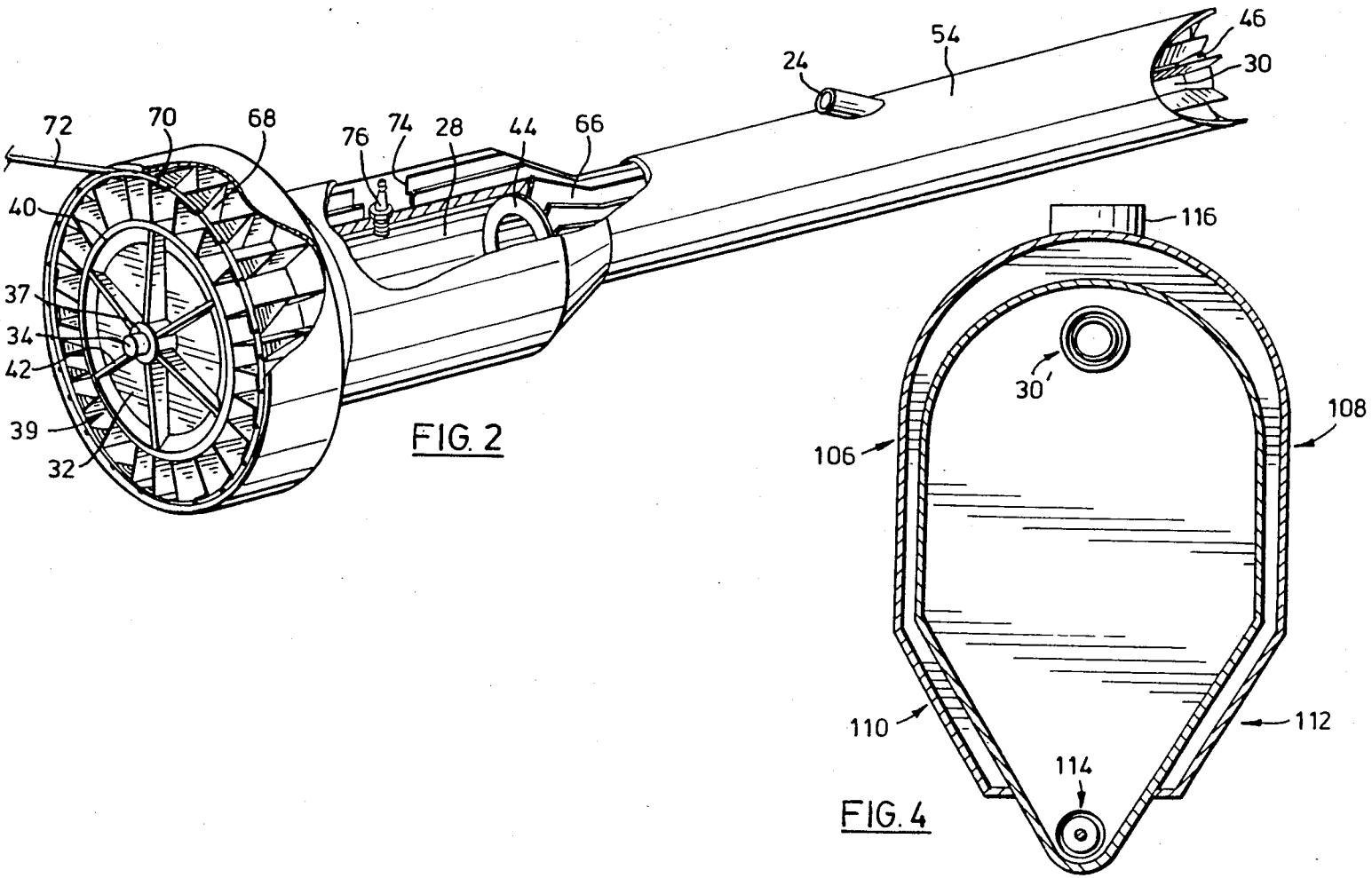
FIG. 2 is a perspective view, partly broken away, of the pulse combustor used in the dehydrator of FIG. 1.

For present purposes, it is sufficient to note that combustion chamber 28 includes a valve plate 32 fitted with an array of pressure responsive one-way valves (not shown) which open to admit fuel and air during low pressure portions of each pulse cycle and which close during high pressure portions of the cycle, all as described in the Kitchen patents and application referred to above. Fuel is supplied through a nozzle 34 from a pump 36 via a filter 38. As best seen in FIG. 2, the fuel supply nozzle 34 is mounted in a boss 36 of a housing 38 at the inlet end of the combustion chamber 28. The housing includes a peripheral annular member 40 from which boss 36 is supported by a series of radial arms 42. Air enters the combustion chamber through the spaces between the arms.

Referring back to FIG. 1, tail pipe 30 includes a restriction 44 at the combustion chamber end and is flared as indicated at 46 at its discharge end. Ideally, the tail pipe would be progressively tapered, as disclosed in British Patent Specification No. 386,908 but for the purpose of the equipment being described, the configuration shown is less expensive and is satisfactory.

The combustion chamber 28 is enclosed by a housing 48 having an access door 50. Housing 48 also contains a blower 58 driven by a motor 60. This arrangement reduces the noise produced by the air inlet valves of the pulse combustor. Blower 58 has an inlet coupled by a pipe 61 to a space between double external walls 22*a*, 22*b* of a cyclone chamber (see later) of the cyclone separator; and air inlet to that space is denoted 56. Blower 58 also has a discharge 62 within housing 48. In operation, air is drawn around the cyclone chamber of the cyclone separator by blower 58. Air leaving discharge 62 pressurizes housing 48. Since the cyclone chamber will normally be warm (sometimes even hot) the air will be preheated before delivery to the pulse combustor, improving combustion efficiency.

In this particular embodiment, a centrifugal fan-type blower is used. The blower forces air through the pulse combustor and through the cyclone separator (as will be described). Blower 58 not only provides an air flow through the pulse combustor for starting but also remains on after combustion has been established to assist in cooling the combustor and maintaining an optimum temperature for the material being dehydrated.

Referring now to FIG. 2, it will be seen that the combustion chamber and tailpipe 30 are enclosed by a shroud 54 and that radial cooling fins 66 extend outwardly from the combustion chamber and tail pipe to the shroud and define longitudinal air passageways therethrough. Air is drawn through these passageways when the combustor is in operation, both due to the action of blower 58 and due to the injection action of high velocity gases leaving the tail pipe and inducing dilution air. At the upstream end of the shroud 54, a shutter 68 is pivoted to each fin about an axis extending radially of the combustion chamber. Thus, by deflecting the shutters about the respective axes, the quantity of air entering the passageways defined between the fins can be controlled. The shutters 68 of all the fins are connected by a ring 70 and an actuating rod 72 extends tangentially from ring 70 so that the ring can be turned to simultaneously adjust all of the shutters 68. In this way, the cooling effect of the air on the combustion chamber and tail pipe can be regulated as required to maintain an optimum temperature for the material being dehydrated.

Shroud 54 is extended beyond the outer end of the pulse combustor tail pipe 30 by a distance that is marked "L" in FIG. 1. This extension of the shroud has two effects. First, it increases the efficiency of the ejector effect due to the high velocity exhaust leaving the tail pipe 30. Second, the extension tends to constrain some of the particles that leave the tail pipe 30 in the exhaust gases so that those particles are exposed to the effect of negative pressure in the combustion chamber during depression portions of the pulse combustion cycle. In fact, it is believed that some of the particles may even be drawn back into the tail pipe. In any event, the effect of this negative pressure on the particles carried by the exhaust gases is believed to be beneficial in terms of dehydration of the particles. This may in fact be likened to a mechanical shaking effect on the particles.

While the exact length of the shroud extension is not believed to be critical, a significant length is believed to be desirable. For example, it is believed that a preferred length lies in the range of one to three times the internal diameter of the shroud (marked as D in FIG. 1).

A benefit of the injector effect that occurs in the vicinity of the outlet end of tail pipe 30 is that it allows a smaller blower to be used within housing 48 than would otherwise be required. For example, in a practical installation, a 2 h.p. blower was found to be adequate. This compares with much larger blowers (of the order of 20 h.p.) that have been used with prior art pulse combustion dehydrators.

FIG. 2 illustrates the fact that the cooling fins on the combustion chamber are recessed as indicated at 74 to accommodate a spark plug 76 required for initiating combustion within chamber 28. Spark plug 76 is connected to an ignition transformer 78 (FIG. 1) within the housing 48 for use in starting the combustor. Once started, combustion is self-sustaining and the ignition system is switched off.

As indicated previously, material to be dried is injected into the tail pipe of the pulse combustor. The feed arrangement shown in FIG. 1 is particularly designed for dehydrating material in particulate form and different feed arrangements would be used for other materials (see later).

Cyclone separator 22 includes a cyclone chamber 94 defined by the double cylindrical walls 22*a*, 22*b*, which extend about a generally vertical axis A. The chamber has a closed upper end wall 98 and an inlet defined by the tail pipe and shroud of the pulse combustor. Dried material collection means at the lower end of chamber 94 are provided by hopper 26. A closure device 100 is provided at the lower end of the hopper and takes the form of a simple slide valve although other arrangements such, for example, a star valve may be preferred.

Disposed generally centrally of the cyclone chamber 94 is a gas discharge tube 102 which extends to a gas outlet from which the gases escape to atmosphere or to additional collection apparatus, such as separation or bag houses. Tube 102 is open at its lower end 104 so that gases are forced into the tube through its lower end by the combined effect of blower 58 and the pulse combustor.

The pulse combustor tail pipe 30 is oriented to direct the pulsating material-containing gas stream eminating from the pulse combustor into the cyclone chamber tangentially near the top of the cyclone and around the gas discharge tube 102 so that dried material will be separated from the gas stream by centrifugal action and fall under gravity into the hopper 26 while the gases leave the chamber through the gas discharge tube 102.

Figure 3:
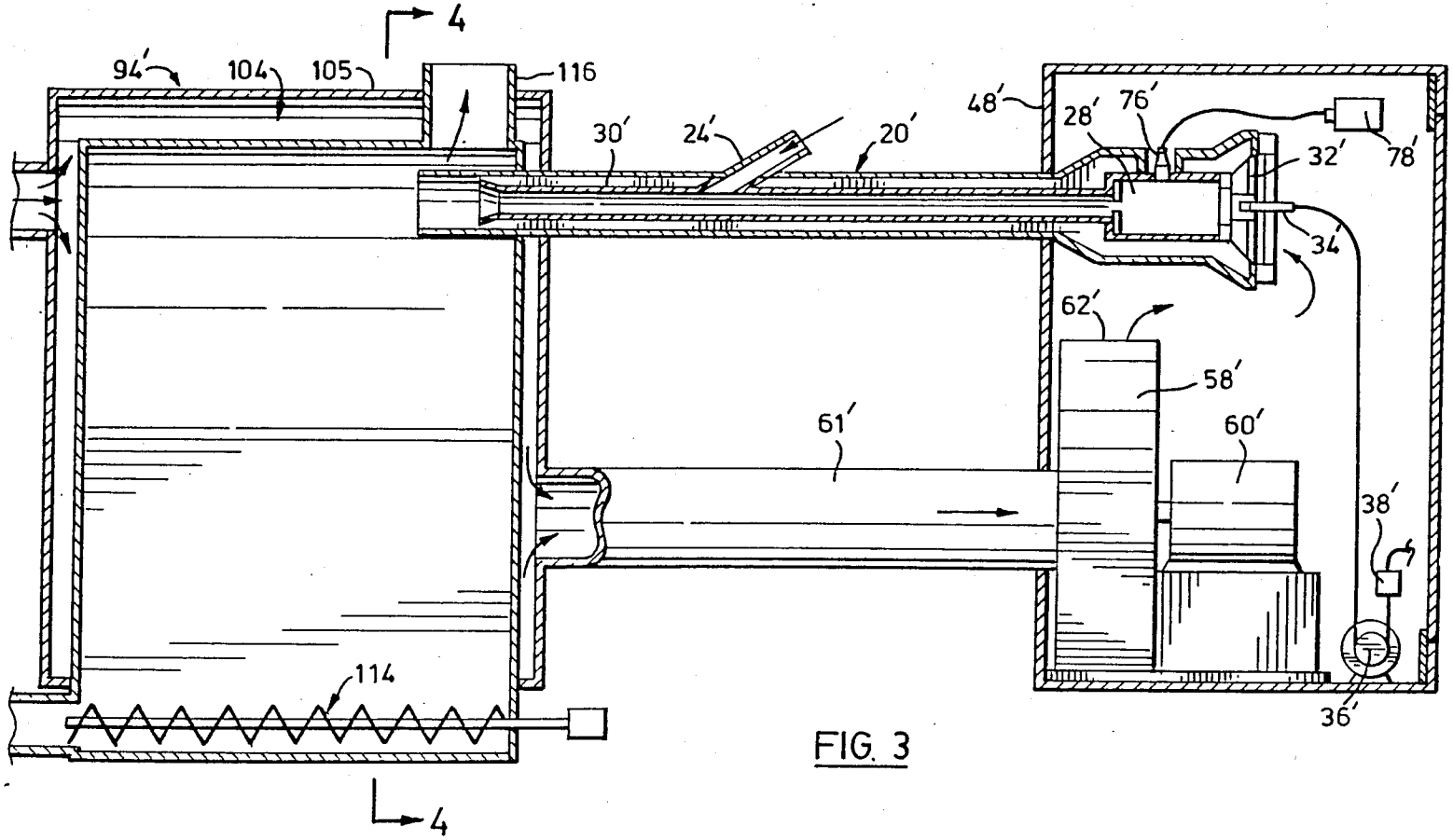
FIG. 3 is a view similar to FIG. 1 illustrating an alternative embodiment of the invention; and, FIG. 4 is a sectional view on line 4—4 of FIG. 3.

FIGS. 3 and 4 illustrate an alternative embodiment of the invention in which primed reference numerals have been used to denote parts corresponding with parts shown in the previous views.

The principal difference between the embodiment of FIGS. 3 and 4 and that of FIGS. 1 to 3 is that the cyclone separator 22 of FIGS. 1 to 3 has been replaced by a simpler collection chamber, denoted 104; the pulse combustor and associated equipment are essentially the same as in the previous views. The collection chamber of FIGS. 3 and 4 would be used in the dehydration of material that might be damaged by impingement against the wall of a cyclone separator, for example seed grain.

FIG. 4 best illustrates the shape of the collection chamber. The chamber is of somewhat laterally elongate form with a rounded top wall 105 and has side walls 106 and 108 (FIG. 4). At their lower ends these walls meet inwardly directed hopper walls 110 and 112 respectively that extend downwardly to a screw conveyor 114. The screw conveyor itself is essentially conventional and serves to remove material that has settled out of the gas stream. Gases leave the chamber through an outlet 116.

It will of course be understood that the embodiments described are preferred embodiments only and that many modifications are possible within the broad scope of the invention. For example, several pulse combustors could be arranged to discharge into the same cyclone separator or collection chamber. For example, in the embodiment of FIGS. 1 to 3, two or three pulse combustors could be equally spaced around the same cyclone separator with each combustor oriented tangentially to the cyclone chamber of the separator.

I claim:

1. A dehydrator comprising:

a pulse combustor including a combustion chamber and an elongate tail pipe forming a resonant system with the combustion chamber, the tail pipe having an inlet for fluent material to be dehydrated and an outlet through which the material is discharged in a pulsating exhaust gas stream when the combustor is in operation; and, a cyclone separator, including: a cyclone chamber having a cylindrical wall extending about a generally vertical axis, a closed upper end wall, and an inlet defined by the tail pipe of the combustor; dried material collection means at a lower end of said chamber; a gas discharge tube disposed generally centrally of the chamber and extending to a gas outlet from the separator; and means for discharging gases from the separator through said tube;

the tail pipe of the pulse combustor being of substantially constant cross-sectional shape throughout its length and extending tangentially into the cyclone chamber to direct said material and gas stream tangentially into said chamber so that said stream travels in a spiral flow pattern downwardly around said gas discharge tube and dried material is separated from the gas stream and falls under gravity into the dried material collection means while gases leave the chamber through said gas discharge tube.

2. A dehydrator as claimed in claim 1, further including blower means for delivering pressurized air to the pulse combustor, and wherein the cyclone chamber of the cyclone separator has a double external wall defining an internal space, said space having an ambient air inlet, and an outlet coupled to an inlet of said blower means, so that, in operation, ambient air is drawn through said space around the cyclone chamber by the blower and delivered to the pulse combustor.

3. A dehydrator as claimed in claim 2, further comprising a housing providing an air cushion chamber for said pulse combustor and wherein said blower means discharges into and pressurizes the interior of said housing for supplying air to the pulse combustor.

4. A dehydrator as claimed in claim 1, wherein the pulse combustor is provided with a plurality of external cooling fins extending generally longitudinally of the tail pipe, a shroud enclosing said fins and defining therewith dilution air passageways extending into said cyclone chamber and along which air is drawn by injection of high velocity gases leaving the tail pipe in use, and means for controlling the volume of combustion air flowing through said passageways.

5. A dehydrator as claimed in claim 4, wherein said external cooling fins also extend generally longitudinally of a combustion chamber of said combustor, and wherein said shroud also encloses said combustion chamber fins whereby the dilution air passageways are defined between the shroud and fins on the combustion chamber and tail pipe.

6. A dehydrator as claimed in claim 4, wherein said means controlling the volume of combustion air flowing through said dilution air passageways comprise a plurality of shutters pivotally coupled to one of said shroud and fins, and means for simultaneously moving all of said shutters between positions in which the dilution air passageways are open and positions in which said passageways are at least partially closed.

7. A dehydrator as claimed in claim 4, wherein said shroud includes a tubular extension that extends beyond the outlet of the tail pipe of the pulse combustor, said extension being of a length in the range between one and three times the internal diameter of the extension.

8. A dehydrator comprising:

a pulse combustor including an elgonate tail pipe having an inlet for fluent material to be dehydrated and an outlet through which the material is discharged in a pulsating exhaust gas stream when the combustor is in operation; and, a collection chamber having an inlet defined by the tail pipe of the combustor, and a gas outlet; and dried material collection means at a lower end of said chamber;

the pulse combustor being provided with a plurality of external cooling fins extending generally longitudinally of the tail pipe, a shroud enclosing said fins and defining therewith dilution air passageways extending into the collection chamber and along which air is drawn by injection of high velocity gases leaving the tail pipe in use, and means for controlling the volume of combustion air flowing through said passageways.

9. A dehydrator as claimed in claim 8, further including blower means for delivering pressurized air to the pulse combustor, and wherein said collection chamber has a double external wall defining an internal space, said space having an ambient air inlet, and an outlet coupled to an inlet of said blower means, so that, in operation, ambient air is drawn through said space around said chamber by the blower and delivered to the pulse combustor.

10. A dehydrator as claimed in claim 8, further comprising a housing providing an air cushion chamber for said pulse combustor and wherein said blower means discharges into and pressurizes the interior of said housing for supplying air to the pulse combustor.

11. A dehydrator as claimed in claim 8, wherein said shroud includes a tubular extension that extends beyond the outlet of the tail pipe of the pulse combustor, said extension being of a length in the range between one and three times the internal diameter of the extension.

12. A dehydrator comprising:

a pulse combustor including an elongate tail pipe having an inlet for fluent material to be dehydrated and an outlet through which the material is discharged in a pulsating exhaust gas stream when the combustor is in operation;

a cyclone separator including: a cyclone chamber having a cylindrical wall extending about a generally vertical axis, a closed upper end wall, and an inlet defined by the tail pipe of the combustor; dried material collection means at a lower end of said chamber; a gas discharge tube disposed generally centrally of the chamber and extending to a gas outlet from the separator; and means for discharging gases from the separator through said tube;

the tail pipe of the pulse combustor being oriented to direct said material and gas stream tangentially into the cyclone chamber so that said stream travels in a sprial flow pattern downwardly around said gas discharge tube and dried material is separated from the gas stream and falls under gravity into the dried material collection means while gases leave the chamber through said gas discharge tube; and, blower means for delivering pressurized air to the pulse combustor;

the cyclone chamber of the cyclone separator having a double external wall defining an internal space, said space having an ambient air inlet, and an outlet coupled to said an inlet of said blower means so that, in operation, ambient air is drawn through said space around the cyclone chamber by the blower and delivered to the pulse combustor.

13. A dehydrator as claimed in claim 12, further comprising a housing providing an air cushion chamber for said pulse combustor and wherein said blower means discharges into sand pressurizes the interior of said housing for supplying air to the pulse combustor.

14. A dehydrator as claimed in claim 12, wherein the pulse combustor is provided with a plurality of external cooling fins extending generally longitudinally of the tail pipe, a shroud enclosing said fins and defining therewith dilution air passageways extending into said cyclone chamber and along which air is drawn by injection of high velocity gases leaving the tail pipe in use, and means for controlling the volume of combustion air flowing through said passageways.

15. A dehydrator as claimed in claim 14, wherein said external cooling fins also extend generally longitudinally of a combustion chamber of said combustor, and wherein said shroud also encloses said combustion chamber fins whereby the dilution air passageways are defined between the shroud and fins on the combustion chamber and tail pipe.

16. A dehydrator as claimed in claim 14, wherein said means controlling the volume of combustion air flowing through said dilution air passageways comprise a plurality of shutters pivotally coupled to one of said shroud and fins, and means for simultaneously moving all of said shutters between positions in which the dilution air passageways are open and positions in which said passageways are at least partially closed.

17. A dehydrator as claimed in claim 14, wherein said shroud includes a tubular extension that extends beyond the outlet of the tail pipe of the pulse combustor, said extension being of a length in the range between one and three times the internal diameter of the extension.

* * * * *